United States Patent [19]

Steinhilber

[11] Patent Number: 4,986,530

[45] Date of Patent: Jan. 22, 1991

[54] SORTING APPARATUS FOR DOCUMENT SHEETS AND THE LIKE

[76] Inventor: Helmut Steinhilber, Sonnenbergstrasse 40, 6052, Hergiswil, Switzerland

[21] Appl. No.: 321,858

[22] Filed: Mar. 10, 1989

[30] Foreign Application Priority Data

Mar. 12, 1988 [DE] Fed. Rep. of Germany ..... 3808332

[51] Int. Cl.[5] ..... B65H 29/18

[52] U.S. Cl. ..... 271/297; 271/220; 271/305

[58] Field of Search ..... 271/297, 303, 305, 296, 271/220

[56] References Cited

U.S. PATENT DOCUMENTS 3,937,459 2/1976 Lawrence .
4,068,837 1/1978 Lamos ..... 271/296
4,317,203 2/1982 Botte ..... 271/296 X
4,349,190 9/1982 Kaneko et al. .
4,469,323 9/1984 Miyashita et al. .
4,494,748 1/1985 Miyashita ..... 271/297 X
4,819,931 4/1989 Goto ..... 271/297 X

FOREIGN PATENT DOCUMENTS 2627502 12/1977 Fed. Rep. of Germany .

*Primary Examiner*—Richard A. Schacher
*Attorney, Agent, or Firm*—Mason, Fenwick & Lawrence

[57] ABSTRACT

A sorting apparatus for sheets of documents or the like, in which the sheets are conveyed on a conveyor belt, and are deflected by controllable deflectors into stacker bins. Roller transporters convey the sheets of documents from the deflector into each stacker bin. The drive of the roller transporters is effected by a driven belt common to the roller transporters of all stacker bins; this belt is activated only for the specifically chosen stacker bin with the roller transporter (26) corresponding to this bin. This actuation is accomplished by a clutch wheel which is tilted by a lever activating the deflector.

17 Claims, 3 Drawing Sheets

SORTING APPARATUS FOR DOCUMENT SHEETS AND THE LIKE

Figure 1:
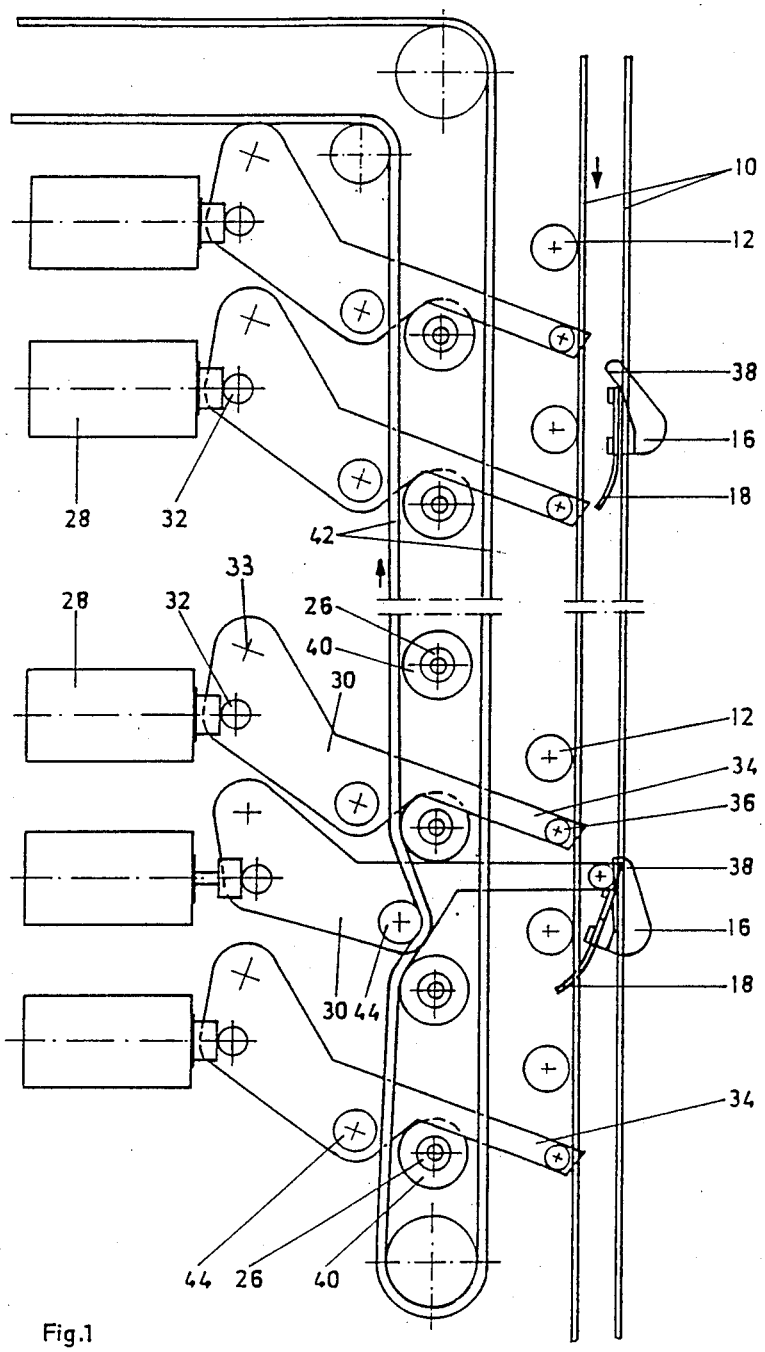

The invention relates to a sorting apparatus for document sheets and the like.

Sorting apparatus for document sheets are coupled to copying machines, data printer and similar devices so that, controlled by deflectors, the printed sheets be distributed into stacker bins. DE-PS 30 36 674 discloses a sorting apparatus of the mentioned type, in which the sheets are moved by a conveyer belt along the bins. Each bin is equipped with a deflector which can be tilted into the plane of the conveyor belt in order to steer the sheet from the feed track into the corresponding bin. The controlled operation of the deflectors is carried out by a rocker arm which strikes against the deflectors and tilts them. This rocker arm is affixed to a plate which is controlled to move along the conveyor belt in order to activate in each instance the chosen deflector. The sheet which is deflected by the deflector is conveyed by a guide plate to the corresponding bin, whereby a driven roller transporter grasps the sheet on the guide plate. The guide plate and the roller transporter are also affixed to the plate moving along the conveyor belt, to which is mounted the lever activating the deflectors. A gear unit drives the roller transporter through the mechanism that moves the plate.

Since the plate with the control lever, the guide plate and the roller transporter always have to be moved along the conveyor belt to the corresponding chosen deflector, this known sorting apparatus operates very slowly, especially when the bins are selected with frequent changes and in a random sequence. The drive of the adjustable plate and the roller supported by it are of costly construction.

DE-OS 26 27 502 discloses a sorting apparatus, in which the sheets transported along a vertical conveyor belt reach the corresponding bins by means of deflectors, whereby the deflectors can be tilted into the plane of the feed track. The sheets that are deflected from the conveyor belt drop directly into the bins. Since the sheets are moved only forwards on the conveyor belt, a complete ejection of the sheets into the bins is not accomplished with certainty.

The present invention has as an object a sorting apparatus for document sheets or the like, which combines a quick selection of the bins with a reliable ejection of the sheets of documents into them.

In accordance with the invention, this object is accomplished for a sorting apparatus of the above mentioned type through apparatus comprising a pivoted deflector, a guide plate with associated roller transporter, and means for pivoting the guide plate and driving the roller transporter.

Advantageous embodiments of the invention are disclosed in the specification and drawings.

In the sorting apparatus according to the invention there is installed a separate guide plate with a driven roller transporter between each deflector and the associated bin. Thus, the deflectors can be directly selected successively in a random sequence, without having to activate in a time consuming manner any controls from one deflector to the next one selected. The roller transporters of all bins are driven in a particularly simple and cost-effective manner by means of a common belt. This belt runs freely along belt pulleys connected to the corresponding roller transporters so that the roller transporters are usually not driven. The belt is pressed by a clutch wheel into gear with the belt pulley of the roller transporter only for the specifically selected bin, in order to drive the roller transporter. In such a manner, only the roller transporter of the specifically selected bin is driven by the belt. Thus, the drive of the roller transporter does not require much power and produces not many bothersome noises.

The clutch wheels are preferably pivoted on levers and, driven by a solenoid, can be moved by these levers into the coupling position.

In a particularly simple structural embodiment the pivoted lever of the clutch wheel activates also the thereto corresponding deflector. Thus, by means of only one solenoid there can be controlled the tilting of the deflector and the drive of the roller transporter.

Furthermore, this lever can also activate a device for holding down the paper stacks already deposited in the corresponding bin in such a manner, that said press pad is lifted by the lever from the stack of papers through the tilting of the lever into the coupling position, so that the next sheet can be freely deposited onto the stack. When the lever tilts back in order to deactivate the deflector and to disengage the drive of the roller transporter, the lever releases anew the press pad so that it is seated again on the deposited stack of papers and compresses it in a space-saving manner.

The invention is hereafter explained in more details by an example of embodiment presented in the drawing.

FIG 1—shows schematically a lateral view of the sorting apparatus

Figure 2:
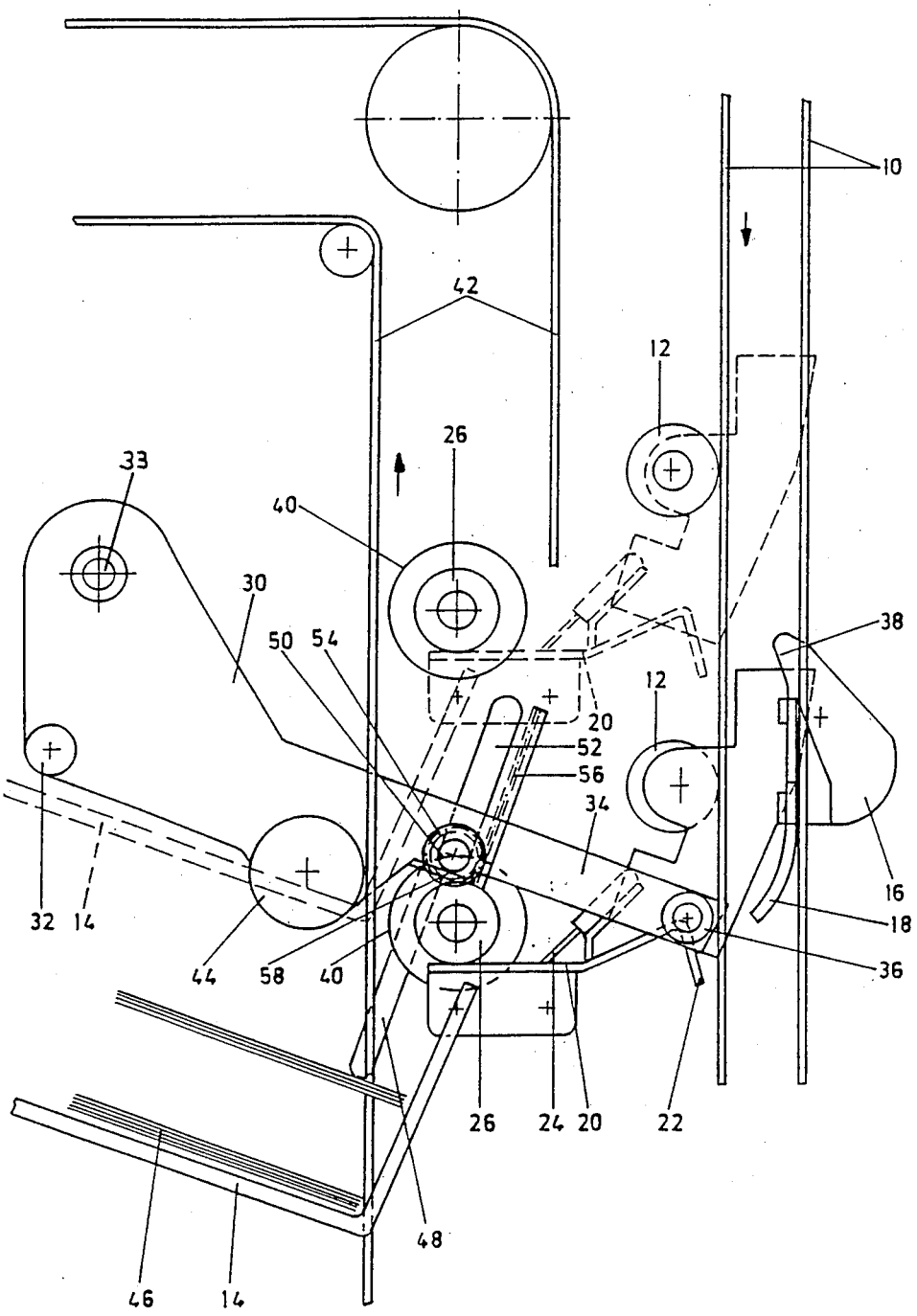
Figure 3:
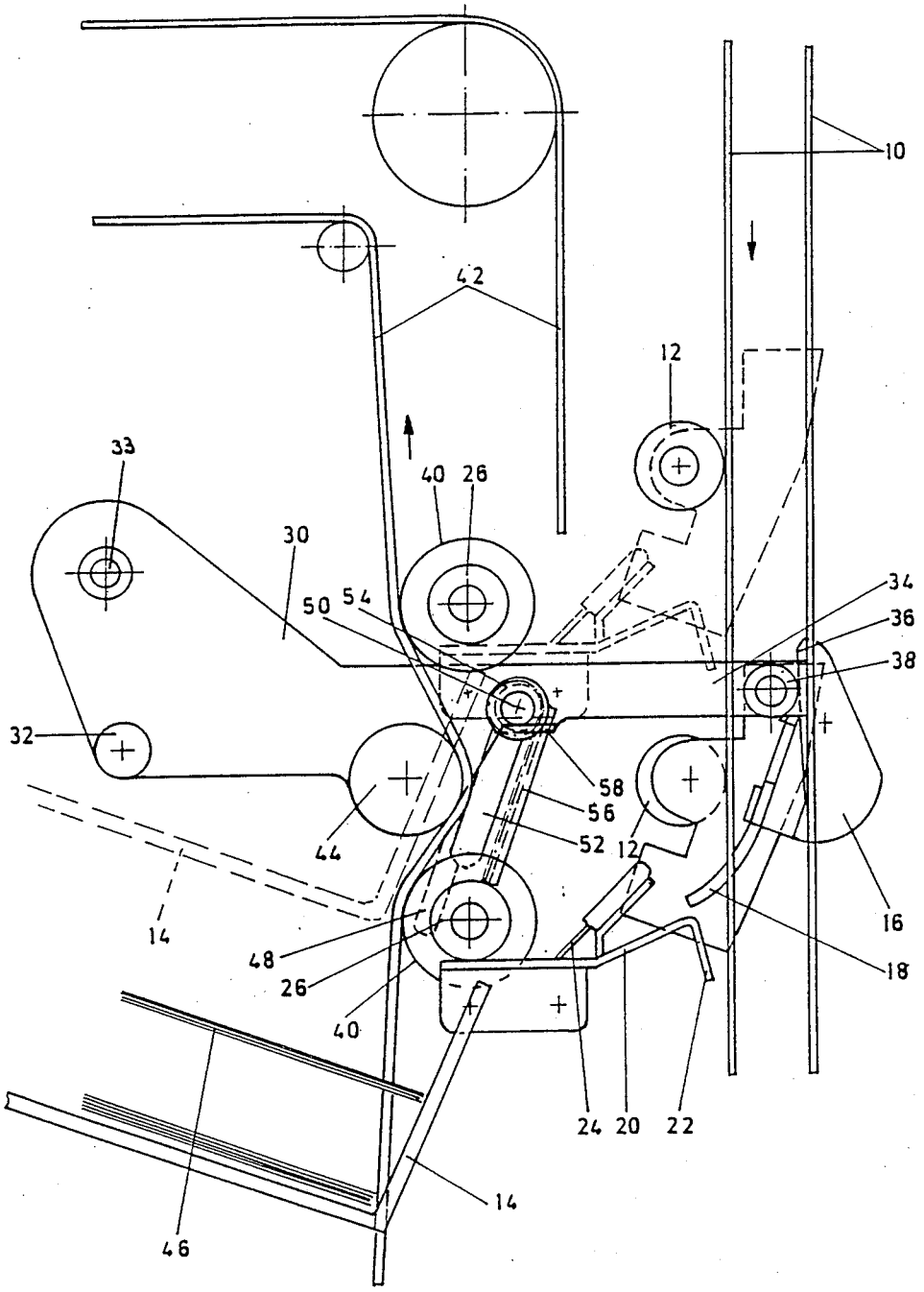

FIG. 2—shows an enlarged side view of a portion of the structure of FIG. 1, of the sheet feed to a bin in its resting position and FIG. 3—shows the structure of FIG. 2 in the specific operating position.

The sheets ejected from a copying machine, a data printer or the like are deposited by a paper feed apparatus (not shown) onto a vertical feed track which is comprised of continuously, driven conveyor belts 10 that are mounted in a flexible manner to same. The drive rollers and guide rollers of the conveyor belts 10 and conveyor rollers 12, not shown in the drawing, are stored between lateral walls (not shown) of the sorting apparatus. The sheets are vertically conveyed downward between the conveyor belts 10 and the conveyor rollers 12.

Between the lateral walls of the sorting apparatus are superposed several stacker bins 14 (see FIGS. 2 and 3) into which the sheets are essentially stacked horizontally one on top of another. To each of the bins is assigned a deflector 16. The deflectors 16 are mounted in a tilting manner between the lateral walls of the sorting apparatus, each of them presenting a deflector surface 18. In the not activated position of FIG. 2 the deflector 16 is kept by its own weight and by a spring in a position in which its deflector surface 18 is behind the downward feeding side of the conveyor belts 10. In the afterwards described operation, shown in FIG. 3, the deflector 16 is tilted in such a manner that its deflector surface 18 passes between the conveyor belts 10. A sheet conveyed downward on the conveyor surface is then deflected by the deflector surface 18 of the deflector 16 from the plane of the conveyor belts 10 and is deposited on a guide plate 20 which is mounted between each of the deflectors 16 and their associated stacker bins 14 and is affixed to the lateral walls. The guide plates 20 are bent downward on their extremity facing the conveyor belt 10 so that they form a guide for the sheets that are conveyed downward between the conveyor rollers 12 and conveyor belts 10. A metal brush 24 on guide plate 20 rests on the top sheet in order to prevent an electrostatic charging of the sheets.

The sheet deposited on the guide plate 20 by the deflector 16 is grasped by a driven roller transporter 26 interacting with the guide plate 20, mounted between the lateral walls, and ejected into the corresponding bin 14.

Each stacker bin is equipped with an electronically controllable solenoid 28 for the drive of the sorting apparatus. Furthermore, associated with each stacker bin 14 is a lever 30, that is pivotally mounted on a lateral wall in a tilting manner. The swivel point of the lever 30 is located at its extremity opposite the solenoid 28, so that lever 30 rests by its own weight with a lug 32 against the armature of the corresponding solenoid 28.

The lever 30 comprises an extension piece 34 providing a free extremity engaging the corresponding deflector 16. If the solenoids 28 of the not selected stacker bins 14 are not energized, their armature is in the retracted position, as shown in FIG. 1 for the upper solenoids 28. Upon actuation of solenoid 28, the corresponding lever 30 follows the movement of the armature and tilts downward into the position shown in FIG. 2, in which its extension piece 34 dislodges from the deflector 16.

If a stacker bin 14 of the sorting apparatus of the copying machine, the data printer or the like is selected for a sheet carried by the conveyor belt 10 to be deposited into this bin 14, the solenoid 24 assigned to this bin 14 is energized and its armature is axially extended, as shown in FIG. 1 for the second solenoid from the bottom. Through lug 32, the solenoid 28 tilts the lever 30 counterclockwise upward around the pivot 33 into the position shown in FIG. 3. Thus, by a roller 36 affixed to its extension piece 34, the lever 30 strikes an abutting surface 38, which is located on the outside of the lateral wall of the sorting apparatus above the deflector 16. Through the force of the roller 36 against the abutting surface 38, the deflector 16 is tilted into the operating position shown in FIG. 3, in which it extends with its deflector surface 18 into the feed track of the conveyor belt.

For the drive of the roller transporters 26, each is provided with a drive pulley 40 on the outside of the lateral walls of the sorting apparatus. A driven, endless revolving belt 42 runs at a slight radial distance from the drive pulleys 40, so that it does not come into contact with the drive pulleys 40, thereby not driving these drive pulleys 40 and, thus, the roller transporters 26. At each of the levers 30 in the region of the belt 42 there is pivoted a clutch wheel 44. With the solenoid 28 not energized, the lever is in the downward tilted position shown in FIG. 2, its clutch wheel 44 is on the side of the belt 42 opposite to from the drive pulleys 40 at a slight distance from this belt 42. Thus, the belt 42 does not come into contact either with the clutch wheel 44 nor with the drive pulley 40 so that the belt 42 travels noiselessly and without power consumption.

Upon energization of the chosen solenoid 28, the lever 30 is tilted upward into the position shown in FIG. 3, and its clutch wheel 44 comes into contact with the belt 42 and presses the belt in the region between the drive pulleys 40 of the chosen stacker bin 14 and the bin 14 mounted above it against these wheel pulleys 40. The belt 42 is thus maintained under pressure, by the clutch wheel 44 against these two drive pulleys 40, so that the belt 42 drives the drive pulleys 40 and thus the roller transporters 26 driven by them.

Simultaneously with the pivoting of the selected deflector 16, there is thus is coupled the drive of the corresponding roller transporter 26.

If the deflector 16 swung out of the feed track, the drive of the associated roller transporter 26 is disengaged.

On the stack 46 of the sheets deposited in the stacker bin 14 is seated a holding-down device 48 in order to press down the stack of papers in a space-saving manner. The holding-down device 48 is essentially shaped like a toothed plate resting vertically on the stack 46. The holding-down device 48 is mounted between the lateral walls in a sliding manner particular to the surface of the stack of papers. In the holding-down device 48 there is pivoted an axle 50 on the upper edge opposite to the stack. Both extremities of the axle 50 extend through slots 52 in the lateral walls, which extend in the direction of movement of the holding-down device 52. On the outside of the lateral walls there is mounted torsionless a pinion 54 on each of the two extremities of the axle 50. The pinions 54 mesh in each instance with a gear rack 56 mounted on the lateral wall, running parallel to the slotted hole 52. Through the pinions 54, running in the gear racks 56 on both extremities of the axle 50, it is ensured that the holding-down device 46 can lift and drop only in a parallel manner.

On each of the levers 30 there is provided a tongue 58 curved away from the deflector plane, which is below and rests against the extremity of the axle 50. If the lever 30 is in the lowered position shown in FIG. 2, the holding-down device 48 resting with its axle 50 on the tongue 58 can move downward because of its own weight until it is seated on the stack 46 in the bin 14. If a bin 14 is selected and the corresponding lever 30 is tilted upward by the solenoid 28 into the position shown in FIG. 3, the lever 30 with its tongue 58 carries with it the holding-down device 48 and lifts it from the stack 46. Thus, the sheet of paper conveyed by the selected deflector 16 can be freely ejected by the roller transporter 26 into the stacker bin 14. If subsequently the lever 30 tilts downward again, the holding-down device 46 is lowered to the conveyed sheet of paper and presses it down on stack 46.

What is claimed is:

1. Sorting apparatus for document sheets and the like with a feed track for the sheets, with stacker bins installed consecutively in the conveyance direction of the sheets at an angle to the feed track, with a deflector for each of the bins that can be swung into the plane of the feed track in order to guide a sheet from the feed track into the corresponding stacker bin, and with a roller transporter interacting with a guide plate, which conveys the sheet of paper from the deflector to the stacker bin, characterized by the fact that between each deflector (16) and each stacker bin (14) there is installed a roller transporter (26), that the roller transporters (26) are equipped with wheel pulleys (40) that can be driven by a revolving belt (42) common to all roller transporters (26), that the belt (42) moves freely with radial clearance along the wheel pulleys (40), and that to each stacker bin (14) is assigned a clutch wheel (44) which, with activating of the corresponding deflector (16), can be moved into a coupling position, in which it presses the belt (42) into gear with the corresponding wheel pulley (40).

2. Sorting apparatus according to claim 1, characterized by the fact that the clutch wheels (44) act upon the belt (42) between two successive wheel pulleys (40).

3. Sorting apparatus according to claim 1, characterized by the fact that each of the clutch wheels (44)is mounted on a swing lever (30) and that they can be tilted by this lever (30) into the coupling position.

4. Sorting apparatus according to claim 1, characterized by the fact that the clutch wheels (44) can be moved by a solenoid (28) into the coupling position.

5. Sorting apparatus according to claim 4, characterized by the fact that the solenoids (28) that move the clutch wheels (44) also activate the corresponding deflector (16).

6. Sorting apparatus according to claim 3, characterized by the fact that the levers (30) supporting the clutch wheels (44) can be tilted by means of the solenoid (28) and present an extension piece by means of which, when in the coupling position, they strike the corresponding deflector (16) tilting it into the operating position.

7. Sorting apparatus according to claim 6, characterized by the fact that each of the levers (30) abut to a holding-down device (48) that rests on the stack of sheets (46) of the corresponding stacker bin (14) lifting it in the coupling position from the stack of sheets (46) in order to make possible the depositing of another sheet of paper on the stack of sheets.

8. Apparatus for sorting document sheets and the like comprising:

(a) means for feeding sheets along a feed track,
(b) stacker bins positioned consecutively in the conveyance direction of the sheets at an angle to the feed track of the feeding means,
(c) a deflector for each of the bins,
(d) means for mounting each said deflector for movement into the plane of the feed track for guiding a sheet from the feed track towards the corresponding stacker bin,
(e) a guide plate adjacent each said deflector and associated with each said bin,
(f) roller transporter means each for interacting with each said guide plate for transporting a sheet of paper from a said deflector to a said stacker bin,
(g) pulleys each drivingly connected to a said roller transporter means,
(h) drive belt means adjacent each of said pulleys for selectively driving each of said pulleys, and
(i) means for selectively causing said drive belt means to rotate a said pulley associated with a said bin and for causing a said deflector means associated with said last mentioned bin to move into the plane of said feed track.

9. Sorting apparatus in accordance with claim 8, said last mentioned means comprising a clutch wheel positioned adjacent said drive belt between each two successive pulleys.

10. Sorting apparatus in accordance with claim 8, said last mentioned means comprising a lever associated with each said bin, and means for selectively moving each said lever.

11. Sorting apparatus in accordance with claim 8, said last mentioned means comprising a plurality of solenoids, and a plurality of levers, each said solenoid operatively engaging a said lever for actuation thereof, each said lever having thereon a clutch wheel engageable with said drive belt means for causing said drive belt means to rotate a said pulley.

12. Sorting apparatus in accordance with claim 11, said levers each comprising means for causing a said deflector means to move into the plane of the feed track.

13. Sorting apparatus in accordance with claim 12, wherein said lever comprises means for substantially simultaneously moving said deflector means and for causing said clutch wheel to engage said drive belt.

14. Sorting apparatus in accordance with claim 13, and further comprising a holding-down device associated with each said bin for engaging a stack therein, means for movably mounting and for guiding each said holding-down device for movement in a path generally perpendicular to a stack of papers held in each said bin, said lever comprising means for elevating said holding-down device substantially simultaneously with engagement of said drive belt means by said clutch wheel and engagement of said deflector by said lever.

15. Apparatus for sorting document sheets and the like comprising:

(a) means for feeding sheets along a feed track,
(b) a plurality of stacker bins positioned consecutively in the conveyance direction of the sheets,
(c) means associated with each said bin for deflecting a sheet from the feed track towards said associated stacker bin,
(d) means associated with each said deflecting means for transporting a deflected sheet to said associated stacker bin comprising a wheel and a guide plate, and
(e) plural actuating means each associated with a said deflecting means and a said transporting means for selectively actuating a said associated deflecting means and a said transporting means, each said actuating means comprising:
  (i) an individually energizable motor,
  (ii) plural lever means each for actuating an associated deflecting means, and an associated transporting means,
  (iii) means for moving each said lever means comprising a said motor, and
  (iv) belt and pulley means for rotating said wheel.

16. The apparatus for sorting documents of claim 15, said deflecting means each comprising a deflector, and means for mounting said deflector for movement into said feed track.

17. Apparatus for sorting document sheets and the like comprising:

(a) means for feeding sheets along a feed track,
(b) a plurality of stacker bins positioned consecutively in the conveyance direction of the sheets,
(c) means associated with each said bin for deflecting a sheet from the feed track towards said associated stacker bin,
(d) means associated with each said deflecting means for transporting a deflected sheet to said associated stacker bin,
(e) plural actuating means each associated with a said deflecting means and a said transporting means for selectively actuating a said associated deflecting means and a said transporting means,
(f) sheet holding-down means associated with each said stacker bin for engaging the upper sheet in each said bin, and
(g) means for mounting said holding-down means for movement between a sheet-engaging position and a position remote therefrom,
(h) each said actuating means comprising means for moving said holding-down means from said sheet engaging position.

* * * * *